US005611466A

United States Patent [19]

Hsiao

[11] Patent Number: 5,611,466

[45] Date of Patent: Mar. 18, 1997

[54] RELEASING UNIT FOR A CONTAINER

[76] Inventor: Chung J. Hsiao, No. 88-16, Hsin-Chuang Village, Hsin-Chuang Lane, Lung-Chin Hsiang, Taichung Hsien, Taiwan

[21] Appl. No.: 540,480

[22] Filed: Oct. 10, 1995

[51] Int. Cl.[6] ..... B65D 83/20

[52] U.S. Cl. ..... 222/402.13; 222/566

[58] Field of Search ..... 222/402.1, 402.13, 222/402.2, 566

[56] References Cited

U.S. PATENT DOCUMENTS

| | | | |
|---|---|---|---|
| 2,908,446 | 10/1959 | Strouse | 222/566 X |
| 3,006,510 | 10/1961 | Sagarin | 222/402.13 |
| 3,143,254 | 8/1964 | Vanderhyde | 222/402.13 X |
| 3,209,953 | 10/1965 | Nichol | 222/402.13 X |
| 3,519,173 | 7/1970 | Sagarin | 222/402.13 |
| 3,534,889 | 10/1970 | O'Donnell | 222/402.13 |
| 4,664,300 | 5/1987 | Strickland | 222/402.13 |
| 4,941,600 | 7/1990 | Berriochoa et al. | 222/402.13 |
| 5,333,755 | 8/1994 | Wang et al. | 222/566 X |
| 5,409,143 | 4/1995 | Sigel et al. | 222/566 X |
| 5,477,993 | 12/1995 | Maeda | 222/402.13 |

*Primary Examiner*—Kevin P. Shaver

*Attorney, Agent, or Firm*—Morton J. Rosenberg; David I. Klein

[57] ABSTRACT

A releasing unit for a container in which a pressurized material is received. The releasing unit includes a cap and a nozzle assembly which has a nozzle portion and a hose portion. The nozzle portion has a top and a side wall extending from a periphery of the top. The top has a first tube extending from the top and the first tube has an inverted L-shaped passage defined therein. The hose portion extends from the side wall and has a first passage defined longitudinally therein which communicates with the inverted L-shaped passage. The nozzle assembly is engaged to a releasing valve of the container and the cap has a skirt portion mounted to a top of the container and having a slot defined in the skirt portion for the hose to extend therethrough.

2 Claims, 4 Drawing Sheets

RELEASING UNIT FOR A CONTAINER

BACKGROUND OF THE INVENTION

Field of Invention

The present invention relates to a releasing unit for a container in which a pressurized material is received and more particularly to the releasing unit including a nozzle assembly and a cap wherein the nozzle assembly has a nozzle portion and a hose portion which extends from the nozzle portion integrally and the cap is mounted to the nozzle portion and is engaged to a top of the container.

FIG. 1 shows a convention releasing unit which includes a cap 10, a nozzle assembly 20 and a hose 30, the nozzle assembly 20 has a tubular wall 21 which includes a front portion and a rear portion, a first hook 22 extending from a top of the rear portion of the wall 21 and a receiving tube 23 extending horizontally from the front portion of the wall 21 for the hose 30 being received in the receiving tube 23. A button element 24 is formed and is enclosed by the wall 21, which has an inverted L-shaped passage 241 defined in the button element 24 and communicates with the hose 30 received in the receiving tube 23, the passage 241 receives a releasing valve 40 of a container 41 in which a pressurized material is received such that when the button element 24 is pressed the releasing valve 40 is actuated to release the pressurized material from the releasing valve 40 and the pressurized material is ejected from the hose 30 via the passage 241. The cap 10 has a front portion which is pivotally engaged to the front portion of the wall 21 and a rear portion which has a second hook 11 formed thereto so as to engage to the first hook 22 of the wall 21. Accordingly, the button element 24 can be operated by disengaging the first and the second hooks 22, 11 apart and pivotally from opening the cap 10.

Such a structure has the following shortcomings:

(1) The engagement between the tube 23 and the hose 30 tends to disengage the two elements from each other because a high pressure may "pull" the hose 30 out from the tube 23.

(2) When assembling the hose 30 in the tube 23, it takes a lot of time to assemble them and this means a high manufacturing cost is required.

(3) The hose 30 has a uniform thin wall which is deemed to be weak when a high pressurized material is transferred therethrough.

The present invention intends to provide a releasing unit for a container and which includes a nozzle assembly and a cap mounted to the nozzle assembly, the nozzle assembly includes a nozzle portion and a hose which extends integrally from the nozzle portion so as to mitigate and/or obviate the above-mentioned problems.

SUMMARY OF THE INVENTION

The present invention provides a releasing unit for a container, the releasing unit including including a cap and a nozzle assembly which has a nozzle portion and a hose portion wherein the nozzle portion has a top and a side wall extending downwardly from a periphery of the top, the top having a first tube extending downwardly from the top and the first tube having an inverted L-shaped passage defined therein. The hose portion extends from the side wall and has a first passage defined longitudinally therein which communicates with the inverted L-shaped passage, the cap having a skirt portion and mounted to a top of the container and having a slot defined the skirt portion for the hose extending therethrough.

It is an object of the present invention to provide a releasing unit for a container wherein the hose portion and the nozzle portion are made integrally.

It is another object of the present invention to provide a hose which has at least one enforcement flange extending radially and outwardly from an outer periphery thereof.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
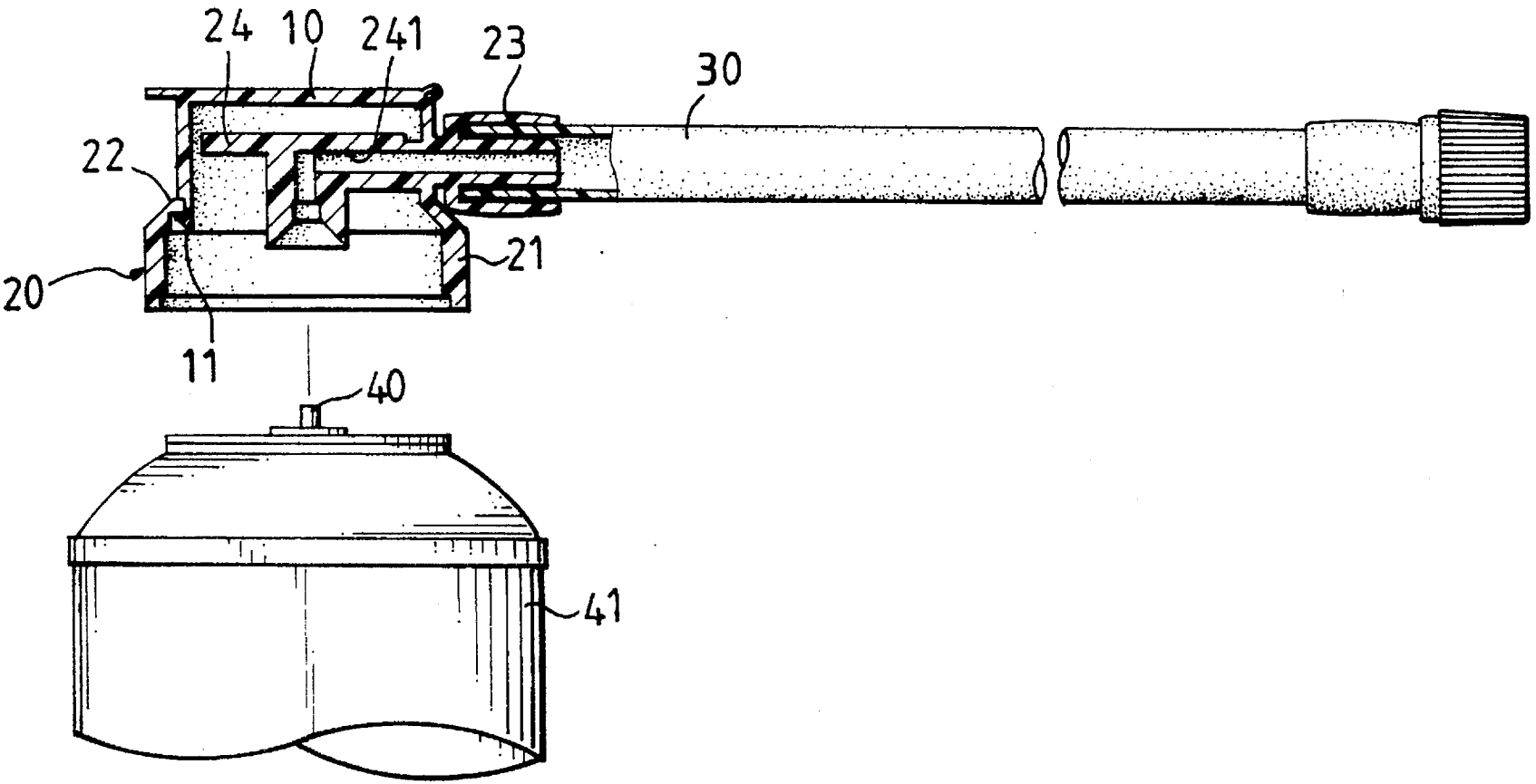
FIG. 1 PRIOR ART
FIG. 1 is a side elevational view, partly in section, of the conventionally releasing unit.
Figure 2:
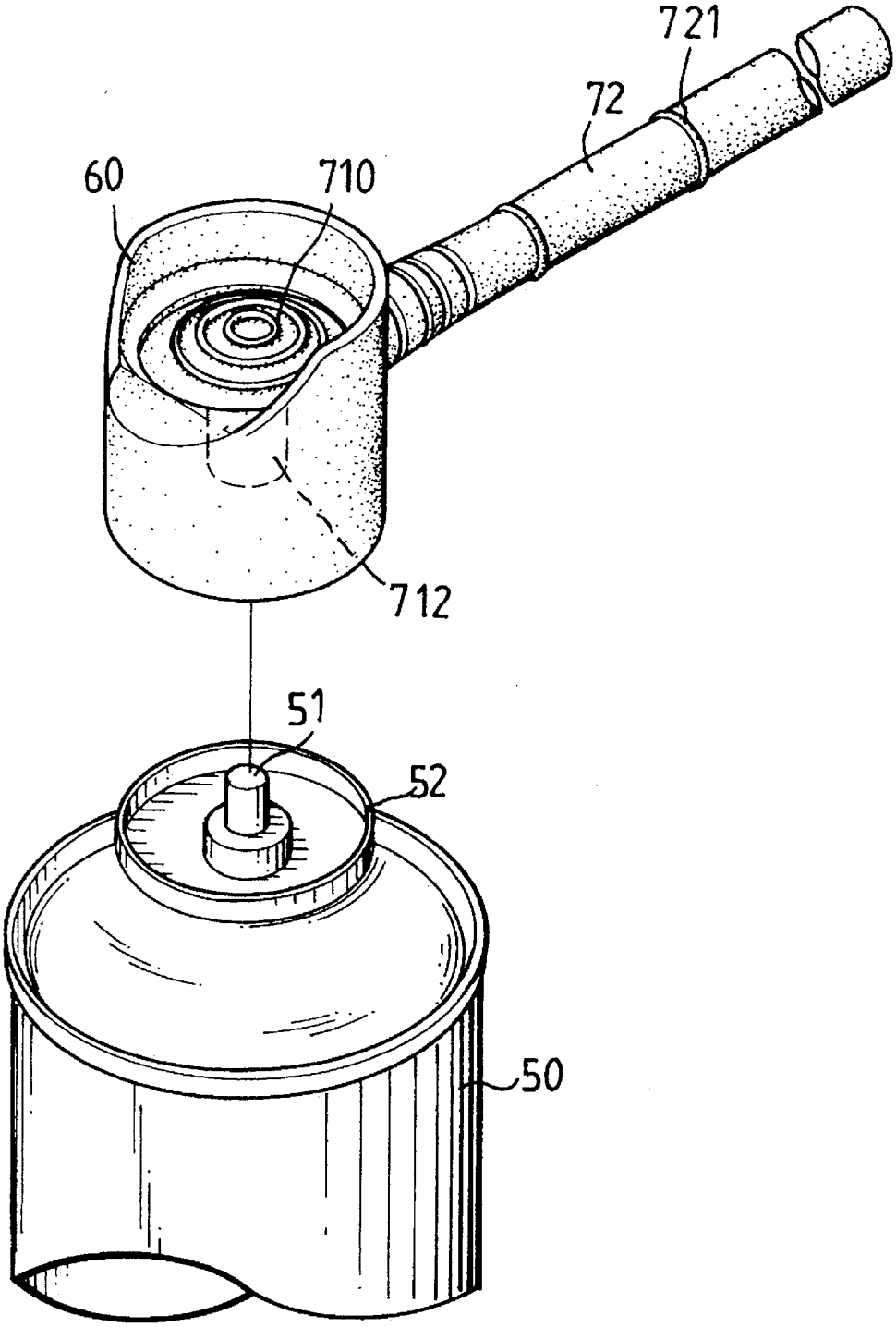
FIG. 2 is an exploded view of a releasing unit in accordance with the present invention and a container.
Figure 3:
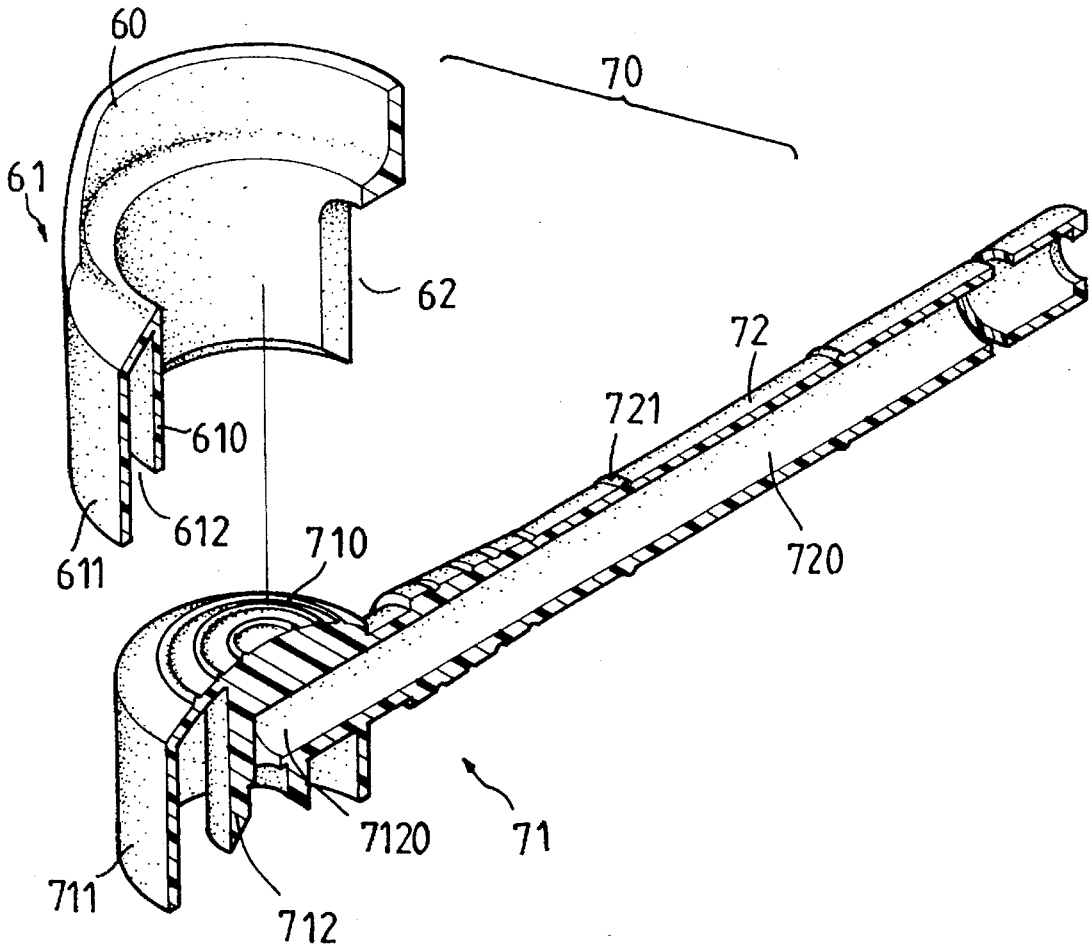
FIG. 3 is an exploded view of the releasing unit in accordance with the present invention.
Figure 4:
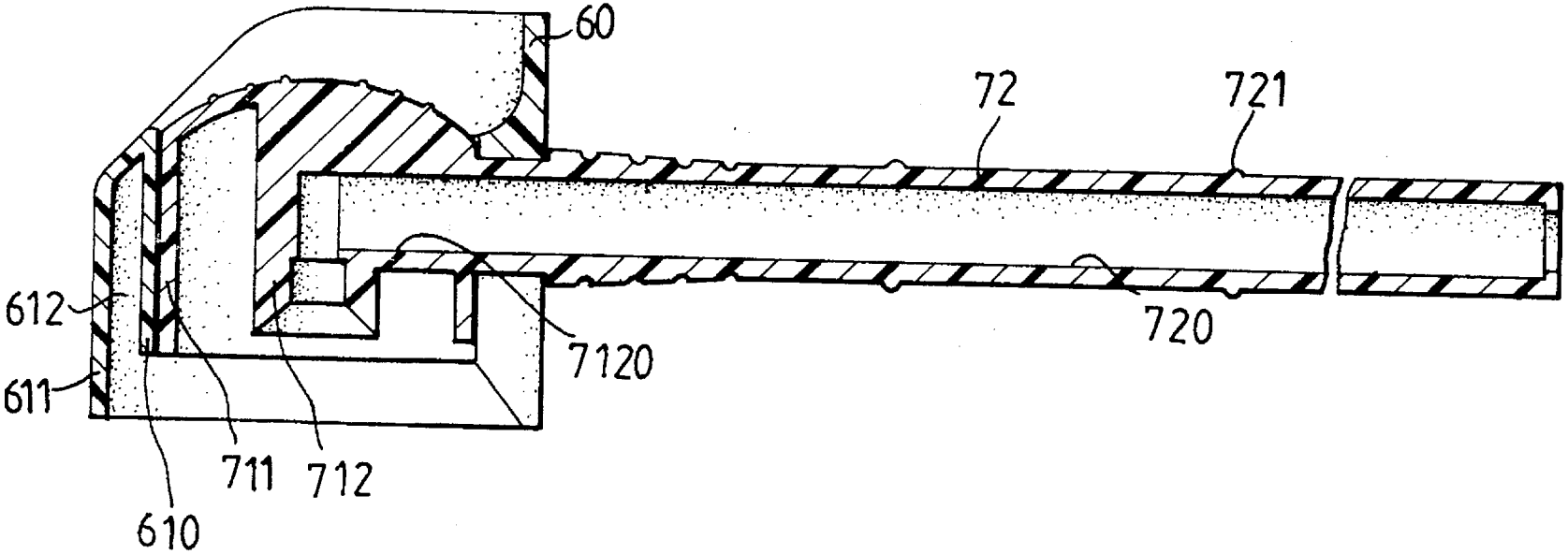
FIG. 4 is a side elevational view, partly in section, of the releasing unit in accordance with the present invention.

Referring to FIGS. 2 through 4, a releasing assembly for a container 50 includes a cap 60 and a nozzle assembly 70, the container 50 has a releasing valve 51 extending upwardly from a top of the container 50 and a flange 52 extending upwardly from the top of the container 50 to enclose the releasing valve 51. The cap 60 is a tubular element and has a skirt portion 61 composed of an inner wall 610 and an outer wall 611, the inner wall 610 and the outer wall 611 connected together on a respective top thereof so as to define a groove 612 therebetween for receiving the flange 52 of the container 50 therein when the cap 60 is mounted to the top of the container 50. The cap 60 has a slot 62 defined in the skirt portion 61 and the slot 62 extending through the inner wall 610 and the outer wall 611.

The nozzle assembly 70 includes a nozzle portion 71 and a hose portion 72, the nozzle portion 71 having a top 710, a side wall 711 extending downwardly from a periphery of the top 710 and a first tube 712 extending downwardly from the top 710, the first tube 712 having an inverted L-shaped passage 7120 defined therein. The hose portion 72 has at least one enforcement flange 721 extending radially and outwardly from an outer periphery thereof and the hose portion 72 extending integrally from the side wall 711 and has a first passage 720 defined longitudinally therein, the first passage 720 communicating with the inverted L-shaped passage 7120 of the first tube 712.

When assembling the releasing unit, the first tube 712 is engaged to the releasing valve 51 of the container 50, the cap 60 is mounted to the nozzle assembly 70 to receive the flange 52 of the container 50 in the groove 612 and the hose portion 72 of the nozzle assembly extending through the recess 62 defined in the skirt portion 61 of the cap 60.

Accordingly, the releasing unit is easy to be engaged to the container 50 and the integral structure of the hose portion 72 and the nozzle portion 71 prevents from leaking, furthermore, the hose portion 72 has at least one enforcement flange 721 such that when transferring a high pressurized material therethrough, the hose portion 72 will not be damaged because of the high pressure.

Although the invention has been explained in relation to its preferred embodiment, it is to be understood that many other possible modifications and variations can be made without departing from the spirit and scope of the invention as hereinafter claimed.

I claim:

1. A releasing assembly for a container, said container has a releasing valve extending upwardly from a top of said container and a flange extending upwardly from said top of said container to enclose said releasing valve, said releasing assembly comprising:

a cap being a tubular element and having a skirt portion composed of an inner wall and an outer wall, said inner wall and said outer wall connected together on a respective top thereof so as to define a groove therebetween for receiving said flange of said container therein, said cap having a slot defined in said skirt portion and said slot extending through said inner wall and said outer wall;

a nozzle assembly including a nozzle portion and a hose portion, said nozzle portion having a top, a side wall extending downwardly from a periphery of said top and a first tube extending downwardly from said top, said first tube having an inverted L-shaped passage defined therein, said hose portion extending integrally from said side wall and having a first passage defined longitudinally therein and said first passage communicating with said inverted L-shaped passage, said first tube engaged to said releasing valve of said container and said hose portion extending through said recess defined in said skirt portion of said cap.

2. The releasing unit as claimed in claim 1 wherein said hose portion has at least one enforcement flange extending radially and outwardly from an outer periphery thereof.

* * * * *